US006474466B1

(12) United States Patent
Barahona

(10) Patent No.: US 6,474,466 B1
(45) Date of Patent: Nov. 5, 2002

(54) EARRING HOLDER

(76) Inventor: Constance R. Barahona, 2093 Hidden Cover Cir. West, Atlantic Beach, FL (US) 32233

( * ) Notice: Subject to any disclaimer, the term of this patent is extended or adjusted under 35 U.S.C. 154(b) by 0 days.

(21) Appl. No.: 09/953,042

(22) Filed: Sep. 14, 2001

(51) Int. Cl.[7] ..... A45C 11/04

(52) U.S. Cl. ..... 206/6.1; 206/495; 206/566; 206/806; 211/85.2

(58) Field of Search ..... 206/6.1, 495, 566, 206/806; 211/85.2; 40/657, 747

(56) References Cited

U.S. PATENT DOCUMENTS 3,186,117 A * 6/1965 Detje ..... 40/747
4,181,224 A * 1/1980 Aber ..... 206/6.1
4,350,249 A * 9/1982 Caston ..... 206/566
4,966,287 A 10/1990 Snyder
5,050,745 A 9/1991 Sanders
D323,755 S 2/1992 Harney
5,253,750 A 10/1993 Keffer
D343,749 S 2/1994 Thompson
5,363,953 A * 11/1994 Carter ..... 206/6.1
5,390,800 A * 2/1995 Tucker ..... 206/6.1
5,419,063 A * 5/1995 Lane ..... 206/6.1
5,427,230 A * 6/1995 Mattox ..... 206/6.1
5,680,928 A 10/1997 Carr

* cited by examiner

*Primary Examiner*—Luan K. Bui

(57) ABSTRACT

An earring holder for holding a plurality of pairs of earrings. The earring holder includes a panel having a first side, a second side and a peripheral edge. A peripheral lip is attached to and extends around the peripheral edge. The peripheral lip has an outer edge. A peripheral ridge is attached to the outer edge and extends around the peripheral lip. The peripheral ridge extends inward such that the ridge extends over the first side of the panel. A cushion member is positioned on the first side of the panel and covers the first side such that edges of the cushion member are positioned between the peripheral ridge and the first side.

3 Claims, 3 Drawing Sheets

EARRING HOLDER

BACKGROUND OF THE INVENTION

1. Field of the Invention

The present invention relates to jewelry storage devices and more particularly pertains to a new earring holder for holding a plurality of pairs of earrings.

2. Description of the Prior Art

The use of jewelry storage devices is known in the prior art. More specifically, jewelry storage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,050,745; U.S. Pat. No. 5,253,750; U.S. Pat. No. 5,680,928; U.S. Pat. No. 4,966,287; U.S. Des. Pat. No. 343,749; and U.S. Des. Pat. No. 323,755.

While these devices fulfill their respective, particular objectives and requirements, the aforementioned patents do not disclose a new earring holder. The inventive device includes a panel having a first side, a second side and a peripheral edge. A peripheral lip is attached to and extends around the peripheral edge. The peripheral lip has an outer edge. A peripheral ridge is attached to the outer edge and extends around the peripheral lip. The peripheral ridge extends inward such that the ridge extends over the first side of the panel. A cushion member is positioned on the first side of the panel and covers the first side such that edges of the cushion member are positioned between the peripheral ridge and the first side.

In these respects, the earring holder according to the present invention substantially departs from the conventional concepts and designs of the prior art, and in so doing provides an apparatus primarily developed for the purpose of holding a plurality of pairs of earrings.

SUMMARY OF THE INVENTION

In view of the foregoing disadvantages inherent in the known types of jewelry storage devices now present in the prior art, the present invention provides a new earring holder construction wherein the same can be utilized for holding a plurality of pairs of earrings.

The general purpose of the present invention, which will be described subsequently in greater detail, is to provide a new earring holder apparatus and method which has many of the advantages of the jewelry storage devices mentioned heretofore and many novel features that result in a new earring holder which is not anticipated, rendered obvious, suggested, or even implied by any of the prior art jewelry storage devices, either alone or in any combination thereof.

To attain this, the present invention generally comprises a panel having a first side, a second side and a peripheral edge. A peripheral lip is attached to and extends around the peripheral edge. The peripheral lip has an outer edge. A peripheral ridge is attached to the outer edge and extends around the peripheral lip. The peripheral ridge extends inward such that the ridge extends over the first side of the panel. A cushion member is positioned on the first side of the panel and covers the first side such that edges of the cushion member are positioned between the peripheral ridge and the first side.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new earring holder apparatus and method which has many of the advantages of the jewelry storage devices mentioned heretofore and many novel features that result in a new earring holder which is not anticipated, rendered obvious, suggested, or even implied by any of the prior art jewelry storage devices, either alone or in any combination thereof.

It is another object of the present invention to provide a new earring holder which may be easily and efficiently manufactured and marketed.

It is a further object of the present invention to provide a new earring holder which is of a durable and reliable construction.

An even further object of the present invention is to provide a new earring holder which is susceptible of a low cost of manufacture with regard to both materials and labor, and which accordingly is then susceptible of low prices of sale to the consuming public, thereby making such earring holder economically available to the buying public.

Still yet another object of the present invention is to provide a new earring holder which provides in the apparatuses and methods of the prior art some of the advantages thereof, while simultaneously overcoming some of the disadvantages normally associated therewith.

Still another object of the present invention is to provide a new earring holder for holding a plurality of pairs of earrings.

Yet another object of the present invention is to provide a new earring holder which includes a panel having a first side, a second side and a peripheral edge. A peripheral lip is attached to and extends around the peripheral edge. The peripheral lip has an outer edge. A peripheral ridge is attached to the outer edge and extends around the peripheral lip. The peripheral ridge extends inward such that the ridge extends over the first side of the panel. A cushion member is positioned on the first side of the panel and covers the first side such that edges of the cushion member are positioned between the peripheral ridge and the first side.

Still yet another object of the present invention is to provide a new earring holder that stores earrings in a manner that allows their easy viewing and such that they are easily retrievable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
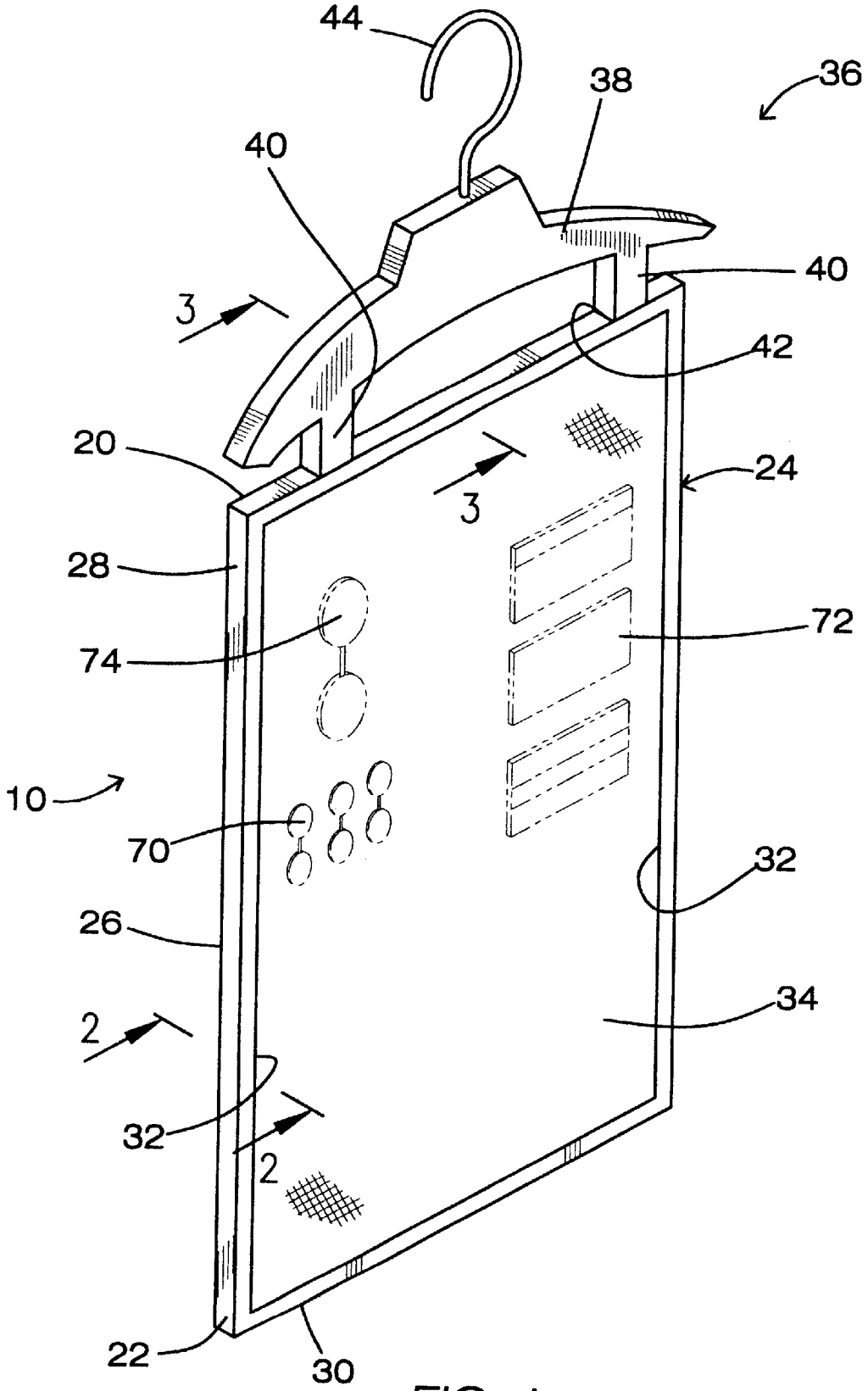
FIG. 1 is a schematic perspective view of a new earring holder according to the present invention.
Figure 2:
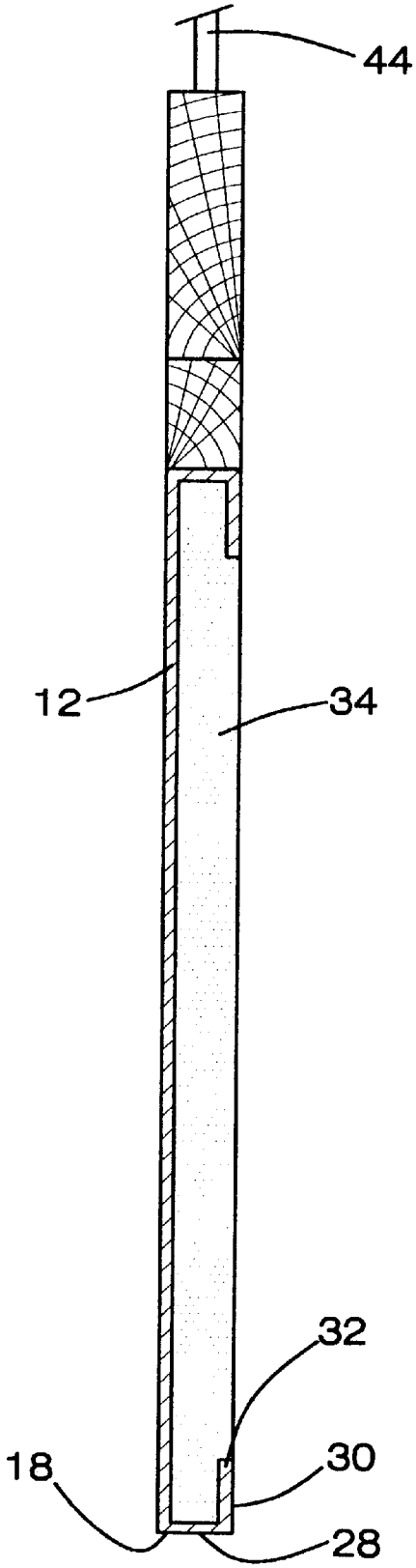
FIG. 2 is a schematic cross-sectional view of the present invention.
Figure 3:
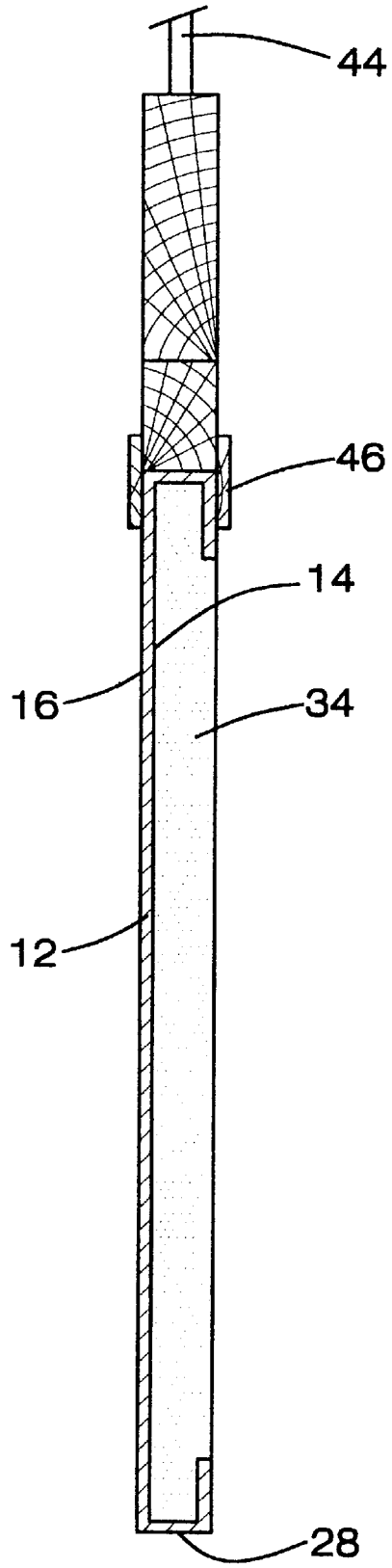
FIG. 3 is a schematic cross-sectional view of a second embodiment of the present invention.

With reference now to the drawings, and in particular to FIGS. 1 and 3 thereof, a new earring holder embodying the principles and concepts of the present invention and generally designated by the reference numeral 10 will be described.

As best illustrated in FIGS. 1 and 3, the earring holder 10 generally comprises a panel 12 has a first side 14, a second side 16 and a peripheral edge 18. The peripheral edge 18 includes a first edge 20, a second edge 22, a third edge 24 and a fourth edge 26 such that the first 20 and second 22 edges are positioned opposite of each other. A peripheral lip 28 is attached to and extends around the peripheral edge 18. The peripheral lip 28 has an outer edge 30. A peripheral ridge 32 is attached to the outer edge 30 and extends around the peripheral lip 18. The peripheral ridge 32 extends inward such that the ridge 32 extends over the first side 14 of the panel 12.

A cushion member 34 is positioned on the first side 14 of the panel 12 and covers the first side 14 such that edges of the cushion member 34 are positioned between the peripheral ridge 32 and the first side 14. The cushion member 34 comprises a resiliently compressible material such as a foamed rubber.

A hanging means 36 is attached to the peripheral lip 28. The hanging means 36 is positioned adjacent to the first edge 20 of the panel 12. The hanging means 36 includes an elongated member 38 having a pair of legs 40 attached thereto and orientated generally perpendicular to the elongated member 38. Each of the legs 40 has an end 42 attached to the peripheral lip 28. A hook member 44 is attached to the elongate member 38 and is positioned generally between opposite ends of the elongated member 38. The hook member 44 extends in a generally opposite direction with respect to the legs 40. Alternatively, the legs 40 may be removably attached to the panel 12 by conventional mechanical fasteners. The ends 42 of the legs 40 may also form clamps 46 for frictionally coupling to the peripheral lip 28.

In use, earrings 70, pins, name tags 72 or other jewelry 74 may be stuck into the cushion 34 for storage and organizing of the jewelry. The hanging means 36 may be user for hanging the device 10 either in a closet or on a wall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An earring storage device for removably attaching a plurality of earrings thereto, said device comprising:

a panel having a first side, a second side and a peripheral edge, a peripheral lip being attached to and extending around said peripheral edge, said peripheral lip having an outer edge, a peripheral ridge being attached to said outer edge and extending around said peripheral lip, said peripheral ridge extending inward such that said ridge extends over said first side of said panel; and a cushion member being positioned on said first side of said panel and covering said first side such that edges of said cushion member are positioned between said peripheral ridge and said first side;

a hanging means being attached to said peripheral lip;

wherein said hanging means includes an elongated member having a pair of legs attached thereto and orientated generally perpendicular to said elongated member, each of said legs having an end attached to said peripheral lip, a hook member being attached to said elongate member and being positioned generally between opposite ends of said elongated member, said hook member extending in a generally opposite direction with respect to said legs.

2. The earring storage device as in claim 1, wherein said cushion member comprises a resiliently compressible material.

3. An earring storage device for removably attaching a plurality of earrings thereto, said device comprising:

a panel having a first side, a second side and a peripheral edge, said peripheral edge including a first edge, a second edge, a third edge and a fourth edge such that said first and second edges are positioned opposite of each other, a peripheral lip being attached to and extending around said peripheral edge, said peripheral lip having an outer edge, a peripheral ridge being attached to said outer edge and extending around said peripheral lip, said peripheral ridge extending inward such that said ridge extends over said first side of said panel;

a cushion member being positioned on said first side of said panel and covering said first side such that edges of said cushion member are positioned between said peripheral ridge and said first side, said cushion member comprising a resiliently compressible material; and a hanging means being attached to said peripheral lip, said hanging means being positioned adjacent to said first edge of said panel, said hanging means including an elongated member having a pair of legs attached thereto and orientated generally perpendicular to said elongated member, each of said legs having an end attached to said peripheral lip, a hook member being attached to said elongate member and being positioned generally between opposite ends of said elongated member, said hook member extending in a generally opposite direction with respect to said legs.

* * * * *